United States Patent [19]

Waters

[11] 3,975,886

[45] Aug. 24, 1976

[54] CAPPING MACHINE

[75] Inventor: Sidney Walter Waters, Poole, England

[73] Assignee: Metal Box Limited, Reading, England

[22] Filed: Sept. 23, 1974

[21] Appl. No.: 508,664

[30] Foreign Application Priority Data

Sept. 27, 1973 United Kingdom ..... 45194/73

[52] U.S. Cl. ..... 53/310; 53/317; 53/331.5

[51] Int. Cl.[2] ..... B65B 7/28; B67B 3/20

[58] Field of Search ..... 53/343, 331.5, 317, 53/306, 310, 311, 367, 312, 290, 112 R, 111 R

[56] References Cited

UNITED STATES PATENTS

| | | | |
|---|---|---|---|
| 1,801,728 | 4/1931 | Doble | 53/306 |
| 1,860,270 | 5/1932 | Thubron | 53/310 X |
| 2,005,585 | 6/1935 | Kantor | 53/311 X |
| 2,030,188 | 2/1936 | Smith | 53/343 X |
| 2,081,809 | 5/1937 | Gladfelter | 53/311 X |
| 2,445,270 | 7/1948 | Hohl | 53/343 X |
| 2,501,291 | 3/1950 | Rue | 53/311 X |
| 2,869,300 | 1/1959 | Stover | 53/290 X |
| 2,996,853 | 8/1961 | Hohl | 53/343 X |
| 3,191,354 | 6/1965 | McElroy et al. | 53/331.5 X |
| 3,246,447 | 4/1966 | Smith et al. | 53/112 R X |
| 3,289,383 | 12/1966 | Foss | 53/112 R X |
| 3,440,798 | 4/1969 | Rackley | 53/317 X |
| 3,714,760 | 2/1973 | Roberts et al. | 53/331.5 X |

*Primary Examiner*—Travis S. McGehee
*Assistant Examiner*—Horace M. Culver
*Attorney, Agent, or Firm*—Diller, Brown, Ramik & Wight

[57] ABSTRACT

This disclosure relates to a capping machine for applying caps to containers, such as jars. The capping machine is provided with a simple automatic cap feed wherein the caps are gravity fed through an orienting chute which directs the caps towards a cap locating station with which there is aligned a capping chuck. The caps are primarily advanced by gravity and as they approach the cap locating station, fluid jets, preferably steam, are directed against the caps to advance them to their positions in alignment with the capping chuck. Means are also provided for directing jets of steam into the top of a container to which a cap is to be applied to displace air between the container neck and the cap and thus create a partial vacuum within the sealed container.

10 Claims, 5 Drawing Figures

CAPPING MACHINE

Figure 1:
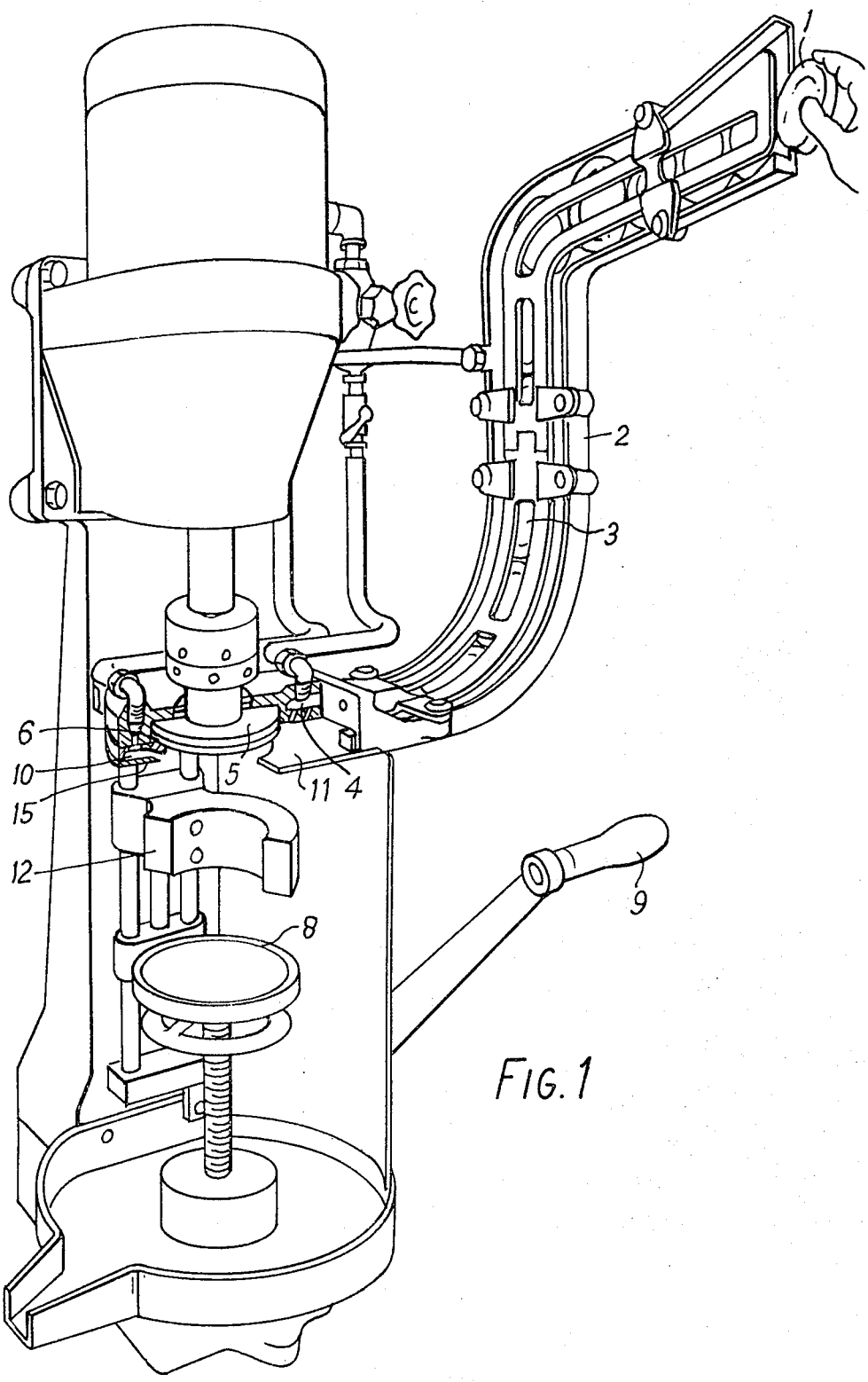

This invention relates to capping machines for applying caps to containers filled, for example, with a food product.

The present invention seeks to provide a capping machine which combines simplicity and cheapness with effectiveness in operation. The invention accordingly provides a capping machine for applying caps in sequence to open-mouthed containers, said machine including a cap feed chute to feed caps in succession to a cap locating means arranged to arrest the caps received from the chute, a capping chuck having cap holding means to engage the cap arrested by the locating means whereby to hold it during the following cap operation, and a container support to receive and support containers to be closed by caps held by the capping chuck, said capping chuck and container support being reciprocable towards and away from each other whereby to enable successive capping operations to be performed on containers successively received on the container support, said cap feeding chute being of a length to hold a substantial number of caps at a time in serial disposition and arranged for the weight of said caps therein to drive the foremost cap of the series to the cap locating means for engagement by the capping chuck.

In order that the invention may be more fully understood an embodiment thereof will now be described, by way of example, with reference to the accompanying drawings. In the drawings:

FIG. 1 is a perspective view of a capping machine in accordance with the invention, partly cut away to show internal structure; and FIGS. 2 to 5 are sectional elevations showing in detail a particular part of the machine of FIG. 1 and depicting various stages in the machine operation.

Referring now to FIG. 1, a capping machine for applying screw-on caps to filled containers comprises a cap feed chute 2 arranged to feed caps 1 individually and in mouth-down disposition to the underside of a capping chuck 5. The chuck 5 is continuously rotated in the appropriate direction about a vertical axis by an electric motor mounted above it.

A lifting platform 8 is vertically moveable by manual operation of a handle 9 between the lower position shown and an upper position in which a container on the platform 8 has its screw-threaded neck engaged by a cap 1 held by the chuck 5. The rotation of the cap by the chuck then screws the cap tightly onto the container as desired. For clarity, no container is shown in FIG. 1.

The general arrangement of the machine is such that an operator seated or standing in front of the machine can place containers in succession on the platform 8 with her left hand, without undue stretching or bending. The chute 2 is mounted generally on the right-hand side of the machine as seen by the operator, and extends generally vertically from a raised mouth to its delivery end adjacent the chuck 5.

In cross-section the chute is generally elongate so as to correspond, with clearance, to the diametral section of the caps 1. Over the length of the chute the major axis of the chute cross-section is directed from front to back of the machine, i.e. it is parallel to the line of sight of the operator. The top end of the chute is inclined forwardly from the vertical towards the operator, so as to present the chute mouth, which is preferably flared conveniently to the operator's right hand. Over this inclined portion and the following vertical portion of the chute, the chute lies generally in a vertical plane directed from front to back of the machine; below the vertical portion, however, the chute turns inwardly through 90° on a large radius of curvature so that at its delivery end adjacent the chuck it is substantially horizontal. It will therefore be seen from FIG. 1 that a cap 1 fed with vertical disposition into the raised mouth of the chute will roll on its rim down the inclined portion of the chute, and after falling down the vertical chute portion will be turned through 90° to arrive beneath the capping chuck 5 in generally horizontal disposition and with its mouth facing downwards as required.

The chute, in particular its vertical portion, is of a length to hold several caps at a time generally one on top of the other, so that each cap in turn may be urged into the capping station, when allowed to do so, by the total or partial weight of the several caps behind it.

FIGS. 2 to 5 show the arrangement of the machine in the immediate vicinity of the chuck 5, and illustrate various stages in the application of a cap received from the chute to a container which is indicated by the reference numeral 7.

Referring now to FIGS. 2 to 5, the chuck 5 has a cap-receiving surface provided by a friction disc 13 which is formed with a central hole and is backed by a metal backing plate. The backing plate is formed with a blind bore to correspond with the hole in the disc 13. An annular cap-locating ring 6 formed with a circular opening slightly greater in diameter than the caps 1 projects below the friction disc 13 around the periphery thereof so as to define a depression in the bottom face of the chuck. A circular permanent magnet 14 is located within the hole in the friction disc and the blind bore of the backing plate and is centrally bolted into position. The magnet 14, the backing plate, the friction disc 13 and the cap-locating ring 6 together form the chuck 5 and are centered on the axis of rotation of the latter, this axis being aligned with the center of the platform 8.

Figure 2:
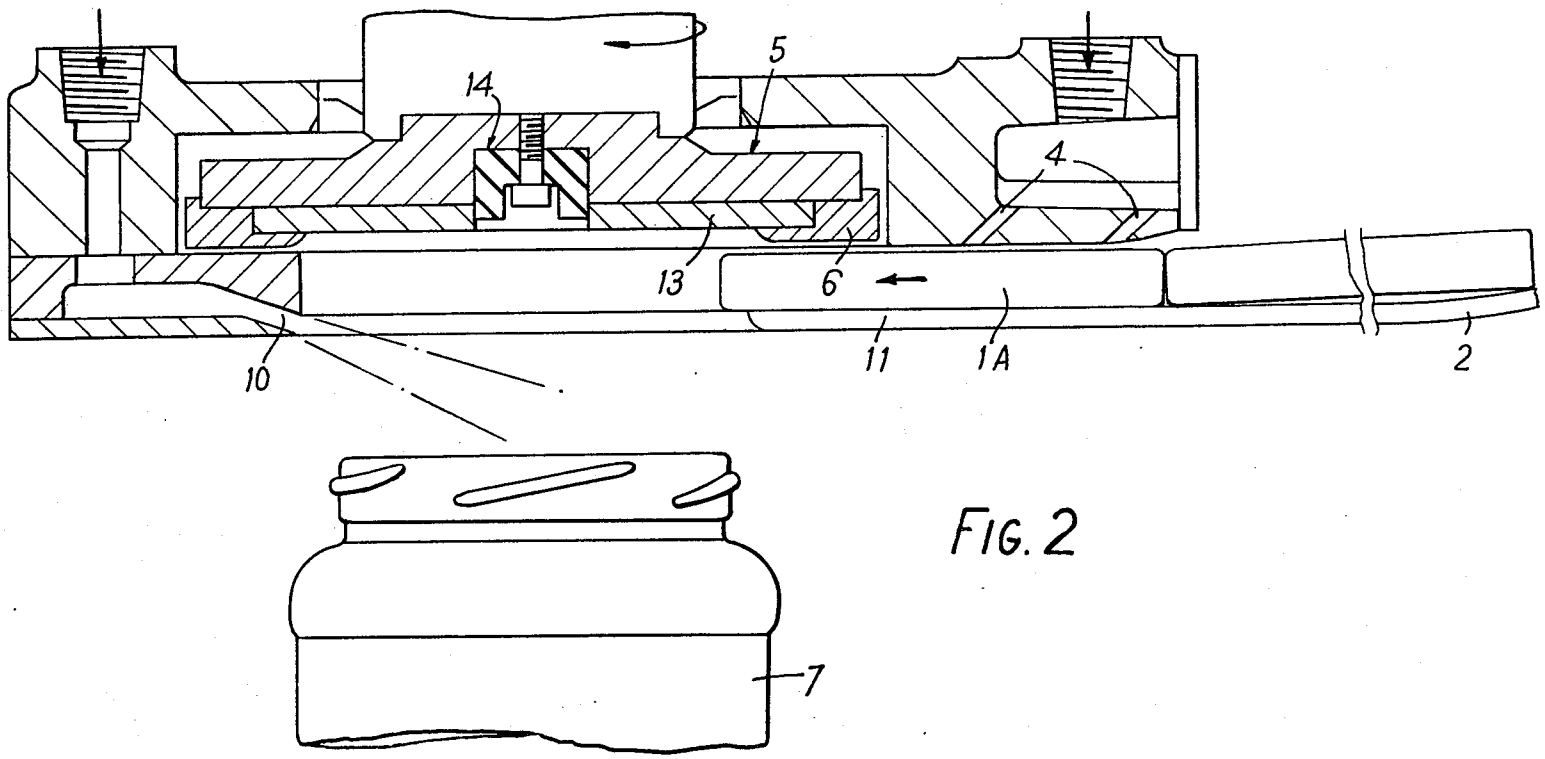

The sequence of operations to apply a cap 1 to a container is as follows, it being initially assumed that, as depicted in FIG. 2, the foremost cap, particularly denoted 1A, of a series of caps each of which has been placed in the chute 2 has left the chute and is being driven by the weight of caps behind it towards the chuck 5. During this time the weight of the cap 1A is supported by a support plate 11 having an aperture centered on, and greater than, the opening in the ring 6.

Figure 3:
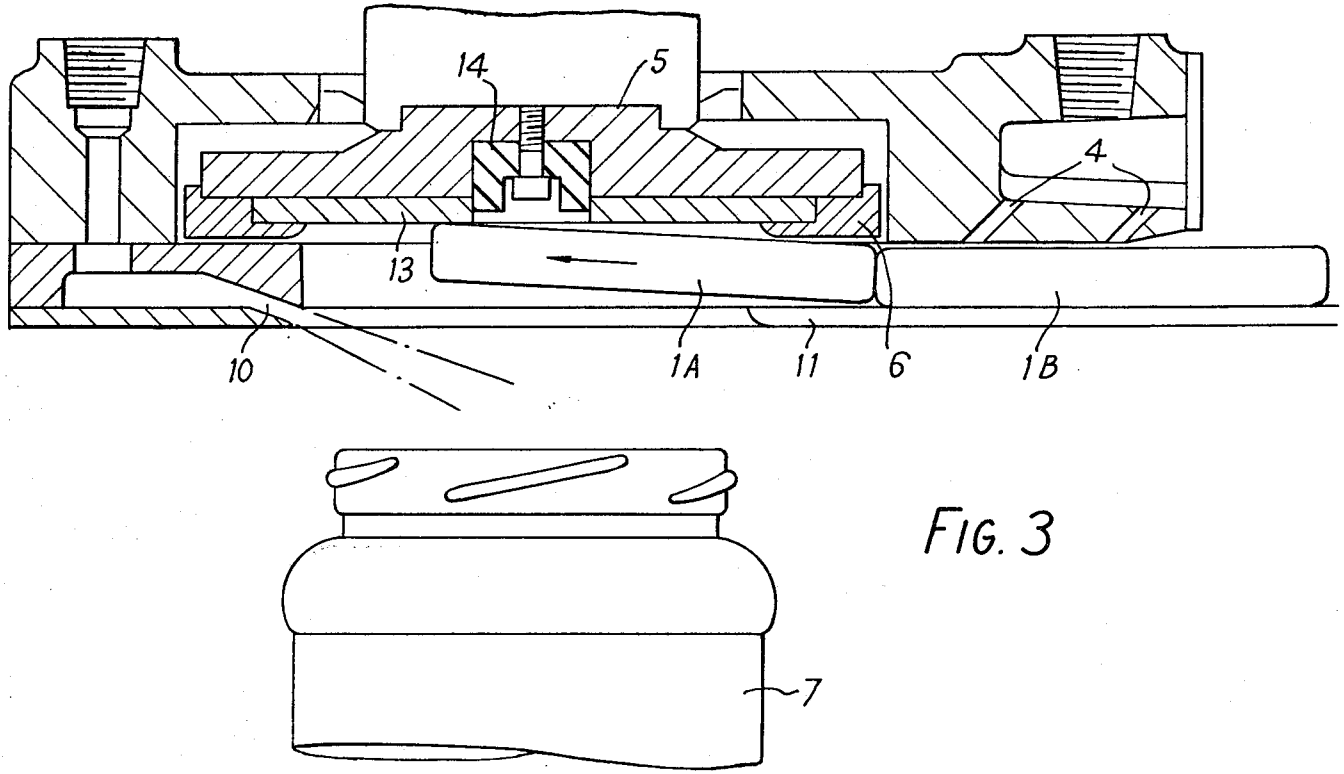

FIG. 3 shows the cap 1A at a slightly later instant of time than is shown in FIG. 2. By this time the cap has moved partly across the aperture in the support plate 11 and has had its leading edge tilted upwardly into contact with the friction disc 13 by magnetic attraction of the magnet 14. At this time the trailing edge of the cap is engaged beneath the ring 6.

During the succeeding movement of the cap the cap leading edge slides across the friction disc until the trailing edge of the cap becomes free of the locating ring and the cap moves upwardly into full engagement with the friction disc. In this position, depicted in FIG. 4, the friction disc is effective to drive the cap to rotate at the speed of the chuck 5.

The magnet 14 is ineffective to pick-up a cap which has incorrectly been fed into the chute 2 and which accordingly arrives beneath the chuck 5 mouth-upwardly. Such a cap will fall harmlessly out of the machine.

It will be understood from the foregoing that the locating ring 6 serves to locate the cap in its desired central position against the friction disc 13. It furthermore ensures that this central position is maintained when the cap is rotated at speed. To assist the initial location of the cap, the bore of the ring 6 is rounded.

While the cap 1A is approaching its final position as described above, the container 7 which has manually been placed on the platform 8 in its downward position (FIGS. 1 to 3) is being raised by operation of the handle 9. Rapid and effective location of the container on the platform is assisted by a locator 12 (FIG. 1).

Figure 4:
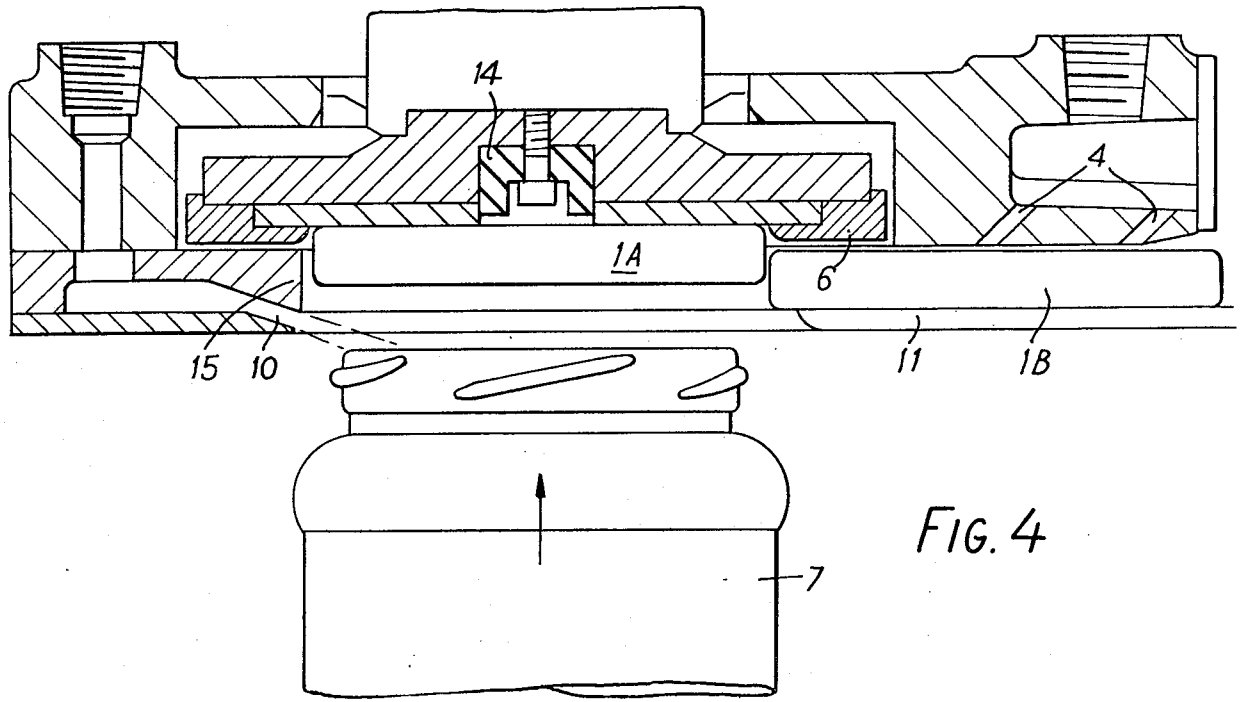
Figure 5:
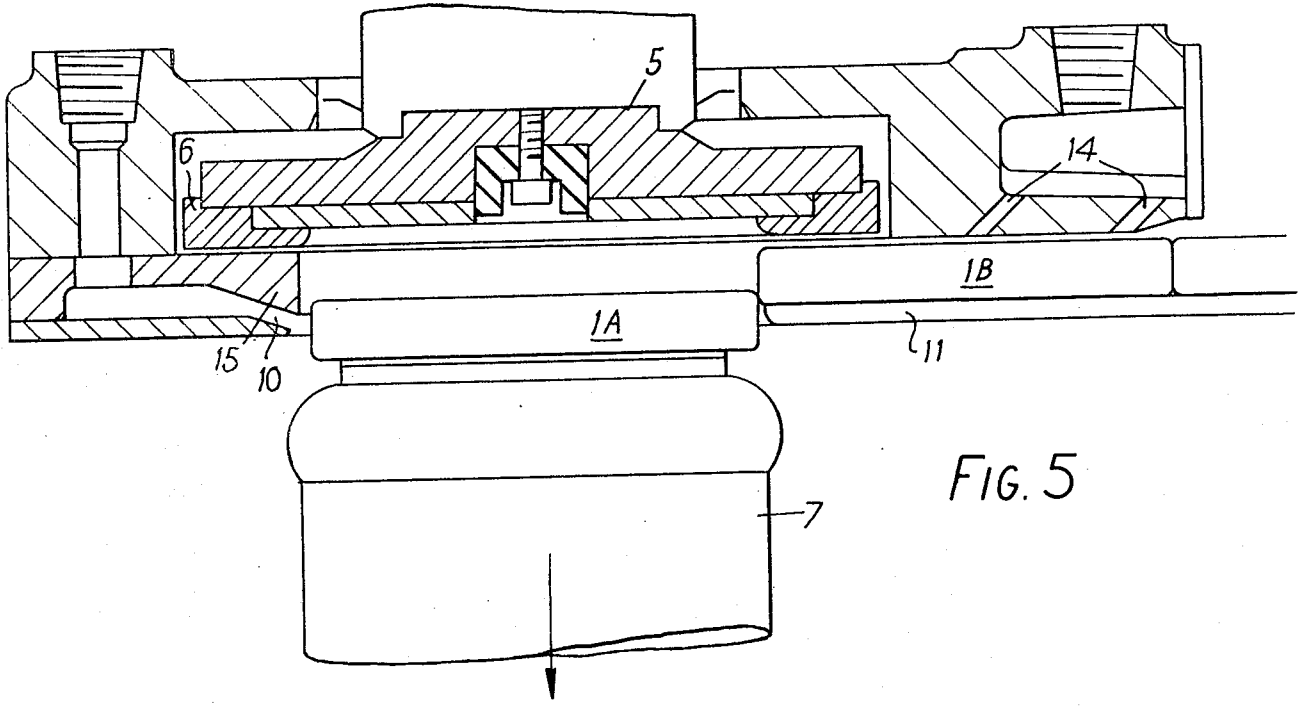

After the cap 1A has moved to the position shown in FIG. 4 the container is brought into engagement with it. By virtue of its rotation the cap then screws down tightly on to the open container neck. The handle 9 is then operated to lower the cap container, whereupon the removal of the cap 1A with the container allows the following cap, denoted 1B, to be pushed underneath the chuck 5 by the caps in the chute 2 in anticipation of the next container 7. The sequence described above is then repeated.

As can be understood from the drawings, stem orifices 4 are located above the support plate 11 and arranged to direct steam on to the caps as they individually approach the chuck 5. The orifices are inclined in the direction of movement of the caps so as to assist the cap movement by virtue of the horizontal component of velocity which they impart to the steam. Further steam orifices 10 are arranged to direct steam into the mouth of a container 7 located on the platform 8 prior to capping. After the container has subsequently been raised and a preheated cap has been applied, the cooling of the container and cap and the condensation of the steam in the container creates in the latter a partial vacuum to ensure an effective seal with the cap.

In a modification of the described arrangement the magnet 14 is replaced by one or more suction caps connected to a source of reduced pressure.

The described embodiment is arranged for applying screw-on caps, and accordingly has its chuck 5 arranged to rotate in the appropriate direction. The described arrangement may, however, be used to apply caps of the press-on kind, in which case the chuck 5 is non-rotatable and its associated drive motor is omitted.

Although particularly described in relation to manual capping machines, the invention may be applied to capping machines subject to at least partial automatic control. One such machine has a plurality of platforms and associated chucks 5 which are mounted on a rotatable turret by which they are indexed in succession past the delivery end of a single chute 2. The chucks 5 and platforms 8 are reciprocable towards and away from one another to effect capping.

In further possible modifications of the described embodiment the chuck 5 and chute 2 are reciprocable in unison towards and away from the platform 8, which is stationary; and the platform 8 is mounted vertically above, instead of below, the chuck 5.

If desired, a pressure relieving catch may be provided in the described embodiment to relieve the weight of caps in the feed chute from a cap which has just entered the chuck. The catch is released when the next cap is subsequently required to move onto the chuck.

What we claim is:

1. In a capping machine, a housing defining a recess, a cap chuck disposed within said recess, a rotatable support carrying said chuck for rotating the same, said chuck having an end face, said end face including centering means for centering a cap relative to said chuck, a cap feed chute opening radially into said recess below said end face, said chute including fixed support means for temporarily supporting a foremost cap in a position partially underlying said chuck, and cap retaining means carried by said chuck independently of said centering means for attracting a foremost cap radially and axially of said end face into said centering means.

2. A capping machine according to claim 1 wherein said cap retaining means are of the type for retaining only caps oriented for application to a container.

3. A capping machine according to claim 1 wherein said cap retaining means are of the magnetic type.

4. A capping machine according to claim 1 wherein said chute has a vertical portion of sufficient vertical extent for the weight of caps serially arranged in said chute to simultaneously push the foremost cap radially into said centering means and a next following cap to a position partially radially projecting into said recess and partially underlying said chuck.

5. A capping machine according to claim 1 together with steam jet means opening into said chute adjacent said recess for preheating caps supplied to said chuck.

6. A capping machine according to claim 5 wherein said steam jet means has a thrust component along said chute towards said recess for aiding in the advancement of said cap into said recess.

7. A capping machine according to claim 1 together with first steam jet means opening into said recess for flushing an open end of a container immediately prior to the application of a cap thereto, and second steam jet means opening into said chute adjacent said recess for preheating caps supplied to said chuck.

8. A capping machine according to claim 1 wherein the foremost cap when positioned in said centering means functions as a stop for the following caps in said chute.

9. A capping machine according to claim 1 wherein said chute has an upper entrance opening positioned for freedom of manual access and of a single cap size wherein caps must be manually serially fed into said chute.

10. A capping machine as claimed in claim 1, wherein the feed chute is mounted generally to one side of the machine, and comprises a vertical portion surmounted by a forwardly inclined portion and surmounting an inwardly turned portion, the inclined portion extending forwardly to a mouth for receiving caps manually fed into the chute by an operator one at a time in front of the machine, the vertical and forwardly inclined portions being of elongate cross-section directed fore and aft of the machine and conforming, with clearance, to the diametral cross-section of the caps, the inwardly turned portions being arranged to turn the caps received from the vertical portion through 90° so that they may pass substantially horizontally to the said means for retention by the chuck.

* * * * *